US006551752B2

(12) United States Patent
Takaya et al.

(10) Patent No.: US 6,551,752 B2
(45) Date of Patent: Apr. 22, 2003

(54) ELECTROPHOTOGRAPHIC PHOTOSENSITIVE MEMBER, PROCESS CARTRIDGE AND ELECTROPHOTOGRAPHIC APPARATUS

(75) Inventors: Itaru Takaya, Numazu (JP); Takeshi Ikeda, Shizuoka-ken (JP); Masataka Kawahara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/922,701

(22) Filed: Aug. 7, 2001

(65) Prior Publication Data

US 2002/0039695 A1 Apr. 4, 2002

(30) Foreign Application Priority Data

Aug. 8, 2000 (JP) ..... 2000/240187
Aug. 8, 2000 (JP) ..... 2000/240188
Aug. 8, 2000 (JP) ..... 2000/240190

(51) Int. Cl.[7] ..... G03G 5/14
(52) U.S. Cl. ..... 430/64; 430/60; 430/131; 399/159
(58) Field of Search ..... 430/60, 64, 65, 430/161; 399/159

(56) References Cited

U.S. PATENT DOCUMENTS 4,933,246 A * 6/1990 Teuscher ..... 430/64
5,045,421 A * 9/1991 Fuse et al. ..... 430/58.05

FOREIGN PATENT DOCUMENTS

| | | | |
|---|---|---|---|
| JP | 48-47344 | | 7/1973 |
| JP | 52-20836 | | 2/1977 |
| JP | 52-25638 | | 2/1977 |
| JP | 53-89435 | | 8/1978 |
| JP | 54-26738 | | 2/1979 |
| JP | 55-103356 | | 8/1980 |
| JP | 62-272277 | | 11/1987 |
| JP | 1309066 A | * | 12/1989 |
| JP | 2004271 A | * | 1/1990 |
| JP | 2-115858 | | 4/1990 |

OTHER PUBLICATIONS

Borsenberger, Paul M. et al. Organic Photoreceptors for Imaging Systems. New York: Marcel–Dekker, Inc. (1993) pp. 6–17 & 289–293.*

* cited by examiner

*Primary Examiner*—Christopher Rodee
(74) *Attorney, Agent, or Firm*—Fitzpatrick Cella, Harper & Scinto

(57) ABSTRACT

An electrophotographic photosensitive member exhibiting good potential characteristic and image forming characteristic fee from difficulties, such as lower image density or black spots and fog, over wide temperature and humidity environment condition, is provided by inserting a specific intermediate layer between a support and a photosensitive layer. The intermediate layer comprises an organic acid aluminum salt compound, preferably formed by heating an aqueous dispersion sol formed by reaction of an organic aluminum compound or a hydrolyzate thereof with an organic acid in an aqueous medium.

8 Claims, 3 Drawing Sheets

ELECTROPHOTOGRAPHIC PHOTOSENSITIVE MEMBER, PROCESS CARTRIDGE AND ELECTROPHOTOGRAPHIC APPARATUS

FIELD OF THE INVENTION AND RELATED ART

The present invention relates to an electrophotographic photosensitive member, particularly one characterized by including an intermediate layer containing a specific aluminum salt compound, and a process cartridge and an electrophotographic apparatus including the photosensitive member.

An electrophotographic photosensitive member generally has a photosensitive layer on an electroconductive support. The photosensitive layer is generally a very thin layer and is liable to have an uneven thickness due to a surface defect or irregularity, such as damages or attachment, on the support surface. This liability is particularly serious in a currently predominant so-called function-separation type photosensitive layer which includes a charge generation layer having a very small thickness on the order of 0.5 $\mu$m and a charge transport layer. As such an ununiformity of photosensitive layer thickness naturally results in potential irregularity or sensitivity irregularity, the photosensitive layer should be formed as uniformly as possible. More specifically, such a potential irregularity or sensitivity irregularity results in images accompanied with black spotty defects (black spots) and fog.

On the other hand, as a measure for providing a sharper potential distribution of electrostatic latent image, there may be conceived of decreasing the photosensitive layer thickness of an electrophotographic photosensitive member. For example, in a lamination type or function separation-type photosensitive member, charges generated in the charge generation layer are injected into the charge transport layer and moved along an electric field to the photosensitive member surface to locally neutralize the surface potential thereat, thereby forming an electrostatic latent image. In this case, if the charge transport layer thickness is reduced to increase the electric field strength and reduce the charge migration distance, the charge diffusion in directions perpendicular to the electric field can be suppressed to provide a sharp electrostatic latent image faithful to exposure light, such as digital laser beam spots. Further, if an electrophotographic photosensitive member is considered as a kind of dielectric member, a smaller photosensitive layer thickness results in a large electrostatic capacitance of the photosensitive member and correspondingly a higher charge density at the photosensitive member surface for providing a prescribed surface potential. As a result, the developing electric field is enhanced and the electrostatic latent image potential distribution is intensified to result in a higher resolution.

However, in a conventional electrophotographic photosensitive member, an increased electric field intensity caused by a smaller photosensitive layer thickness has promoted charge injection from the support side, thus resulting in undesirable phenomena, such as a lower chargeability and so-called fog in the reversal development system. Accordingly, though the photosensitive layer thickness reduction is expected to result in a higher resolution through an improved reproducibility of dots formed by digital exposure light, such as a laser beam, it is also accompanied with difficulties attributable to charge injection, thus leaving a problem for practical application.

For solving the problem, it has been proposed to insert an intermediate layer between the support and the photosensitive layer for the purpose of coating surface defects on the support, improving the adhesion between the support and the photosensitive layer and preventing the carrier injection from the support to the photosensitive layer.

Hitherto, it has been proposed to form such intermediate layers of resins, such as polyamide (JP-A 48-47344 and JP-A 52-25638), polyester (JP-A 52-20836 and JP-A 54-26738), polyurethane (JP-A 53-89435 and JP-A 2-115858), quaternary ammonium salt-containing acrylic polymer (JP-A 51-126149) and casein (JP-A 55-103556). However, an intermediate layer of a material as described above is liable to have an electrical resistance which is liable to change depending on environmental changes, so that it has been difficult to provide an electrophotographic photosensitive member having stable and excellent potential characteristics in all environmentals ranging from low temperature/low humidity to high temperature/high humidity.

For example, in the case where such an electrophotographic photosensitive member is used in a low temperature/low humidity environment liable to cause an increase in resistivity of the intermediate layer, charges are liable to remain in the intermediate layer, thus resulting in increases in light-part potential and residual potential. As a result, the resultant images are liable to be foggy in the case of normal development and are liable to be thinner in image density in the case of reversal development, so that it is difficult to continually obtain images of prescribed image quality. On the other hand, in the case where such an electrophotographic photosensitive member is used in a high temperature/high humidity environment liable to cause a lowering in resistivity of the intermediate layer, the barrier function of the intermediate layer is liable to be lowered, thus resulting in an increased carrier injection from the support and a lowering in dark-part potential. As a result, the resultant images are liable to have a lower image density in the case of normal development and are liable to be accompanied with black spots and fog in the case of reversal development.

JP-A 62-272277 has disclosed to form an intermediate layer by applying a coating liquid comprising a mixture of an organometallic compound, such as a silane coupling agent or a metal alcoxide, in an organic solvent. When such a coating film of an organic solution of a relatively low-molecular weight organometallic compound is subjected to a subsequent drying step, the organometallic compound is hydrolyzed and polymerized to form a cured film having a network structure. However, a cured film obtained through such a process is liable to be cracked at a certain thickness or larger. The resultant crack in the intermediate layer results in a thinner image formation in the normal development or black spots or fog in the reversal development. Accordingly, such an intermediate layer formed by application and curing of a coating liquid obtained by mixing of an organometallic compound in an organic solvent can only be formed in a small thickness. However, such an intermediate layer of only a small thickness is liable to exhibit an insufficient ability of preventing carrier injection from the support to the photosensitive layer, thus also resulting in a lower image density in the normal development and black spots and fog in the reversal development. Accordingly, it is very difficult to satisfy the image quality and potential characteristic in combination. Moreover, such organometallic compounds used for providing an intermediate layer coating liquid, as represented by alkoxides and acetylacetonates of zirconium, titanium and aluminum, are strongly hydrolyzable, and the coating liquid comprising such an orgametallic compound and an organic solvent is liable to cause a precipitate or a viscosity increase as by gelling, thus posing a problem in respect of storage stability.

On the other hand, there have been made a number of proposals of subjecting an aluminum substrate to anodic oxidation to form an anodized aluminum film thereon. However, the anodic oxidation requires special bath and technique which are time-consuming, labored and costly.

SUMMARY OF THE INVENTION

Accordingly, a generic object of the present invention is to provide an electrophotographic photosensitive member having solved the above-mentioned problems of the prior art.

A more specific object of the present invention is to provide an electrophotographic photosensitive member including an intermediate layer which can be formed in a crack-free state inexpensively and without requiring a special technique by using a coating liquid of a good storage stability.

Another object of the present invention is to provide an electrophotographic photosensitive member including such an intermediate layer and capable of exhibiting excellent potential characteristic and image forming characteristic free from difficulties, such as lower image density or black spots and fog, over a variety of temperature and humidity environment conditions even at a smaller thickness of photosensitive layer.

Further objects of the present invention are to provide a process cartridge and an electrophotographic apparatus including such an electrophotographic photosensitive member.

According to the present invention, there is provided an electrophotographic photosensitive member, comprising: a support, an intermediate layer and a photosensitive layer disposed in lamination in this order, wherein the intermediate layer comprises an organic acid aluminum salt compound.

The present invention further provides a process cartridge and an electrophotographic apparatus including the above-mentioned electrophotographic photosensitive member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
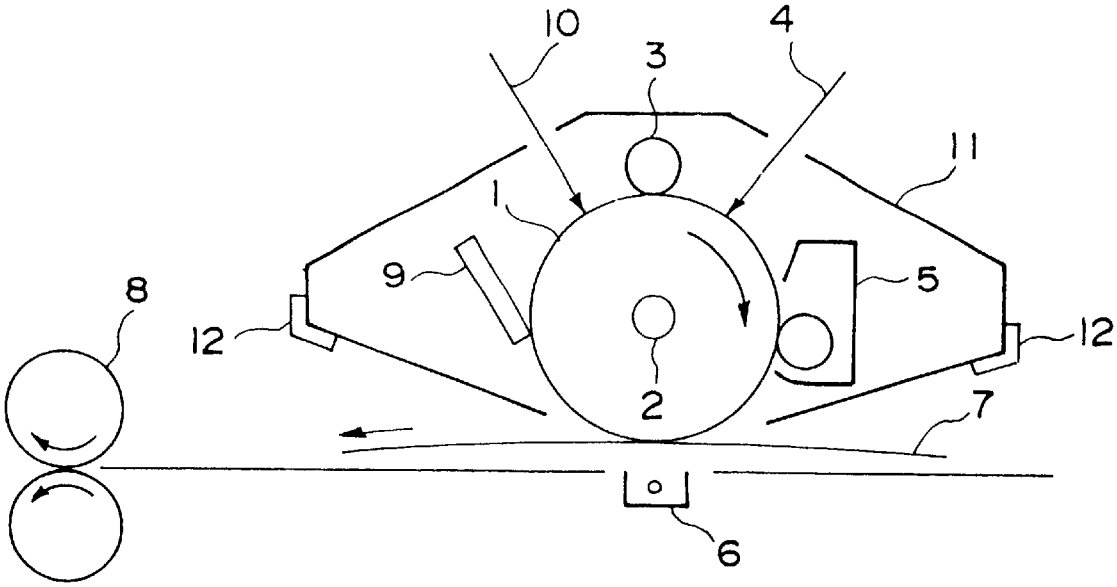
FIG. 1 is a schematic illustration of an electrophotographic apparatus including a process cartridge, which in turn includes an electrophotographic photosensitive member of the invention.

The electrophotographic photosensitive member according to the present invention comprises a support, an intermediate layer and a photosensitive layer laminated in this order, wherein the intermediate layer comprises an organic acid aluminum salt compound. The organic acid aluminum salt compound has at least partially a structure as represented by formula (1) below in view of the results of various analyses described hereinafter:

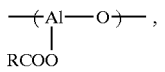

(1)

wherein R denotes an alkyl group constituting an organic acid.

The organic acid aluminum salt compound may be obtained by heating an aqueous dispersion sol formed by reaction of the organic aluminum compound or a hydrolyzate thereof with an organic acid. The heating of the aqueous dispersion sol may be performed by heating a coating layer of the aqueous dispersion sol on the support of the photosensitive member.

Apart from the organic acid aluminum salt compound formed in the above described manner, in case where a hydrolyzable organic aluminum compound is hydrolyzed at a temperature of from room temperature to 100° C., bayerite or boehmite is formed depending on the pH of the hydrolysis medium and is transformed into alumina by heating. So-called alumina sol or boehmite sol is formed by hydrolyzing an organic aluminum compound with a large amount of water or warm water and adding an acid to the aqueous system containing the hydrolyzate, followed by heating for particle growth and dispersion. The solid matter in the sol formed according to the method principally comprises crystalline boehmite particles. As the acid, a strong acid, such as hydrochloric acid or nitric acid is said to be ordinarily used in an amount of suitably 0.05 to 0.1 mol per mol of Al.

In case where the sol formed in the above described manner is applied as a coating and heated to form a film, crystalline boehmite is formed at a heating temperature up to 300–500° C., and crystalline alumina is formed at a higher temperature. This is clarified from results of X-ray diffraction analysis. Ordinary sol thus formed provides a film which shows a broad diffraction pattern showing indices of plane corresponding to boehmite crystal even if it is dried at a very low temperature of below 100° C. as fine particles formed in the liquid comprise boehmite crystals. Broader diffraction peaks may be observed in some cases, and this is attributable to intercalation of water molecules between boehmite layers causing a plane spacing apparently larger than the basic plane spacing of boehmite. Such a state of boehmite is sometimes also called pseudo-boehmite. An example of X-ray diffraction chart of pseudo-boehmite found by using nitric acid as the acid is attached hereto as FIG. 3.

Different from the so-called alumina sol or boehmite sol discussed above, in the aqueous dispersion sol giving the organic acid aluminum salt compound used in the present invention, the formation of boehmite crystal particles is presumably suppressed due to coordination of the organic acid onto aluminum to provide a precursor of the organic acid aluminum salt compound having a structure principally represent by the above formula (1). A film of the organic acid aluminum salt compound formed by drying at a relatively low temperature retains an organic residue and does not show a diffraction pattern of boehmite according to ordinary X-ray diffraction analysis. An example of X-ray diffraction chart of a layer of such an organic acid aluminum salt compound equivalent to an intermediate layer formed in Example 1 for producing a photosensitive member according to the present invention is attached hereto as FIG. 2.

The presence of the structure represented by the formula (1) is corroborated by the fact that a $C^{13}$-NMR spectrum signal corresponding to the carboxy group (—COO—) is observed at a position different from a position corresponding to a free carboxylic acid group (—COOH) and the Raman spectrum exhibits an absorption of the carboxyl group shifted from the absorption of a free carboxylic acid group. From these analysis results, it has been also known that a plurality of bonding modes are observed for the bonding between aluminum and the carboxylic acid presumably including a mode wherein two aluminum atoms are crosslinked by a carboxylic group and a mode where the carboxylic acid is attached to the aluminum atoms as a bidentate ligand, but the above formula (1) is shown as representing all such bonding modes inclusively.

Preferred examples of the organic aluminum compound for providing the organic acid aluminum salt compound forming the intermediate layer may include: alkylaluminums, such as trimethylaluminum and triethylaluminum; aluminum alkoxides, such as aluminum triethoxide, aluminum triisopropoxide and aluminum tri-sec-butoxide; and aluminum chelate compounds as represented by β-diketonate complexes, such as aluminum triacetylacetonate and aluminum tris(ethylacetoacetate). Among these, aluminum tri-sec-butoxide is particularly preferred in view of the easiness of forming the aqueous dispersion sol.

It is preferred that the organic aluminum compound is free from impurities, such as alkali metals, alkaline earth metals or halide ions, for producing the organic acid aluminum salt compound.

An organic acid for providing the coating liquid for the intermediate layer is also preferred so as not to corrode the support or a primer layer thereon. As the organic acid, it is particularly preferred to use acetic acid or formic acid. When such a carboxylic acid (RCOOH) capable of functioning as a ligand showing a strong bonding force is added to an organic aluminum compound, an exchange of ligands is caused to provide an organic acid salt structure as represented by the above formula (1).

The aqueous dispersion sol used as a coating liquid for forming the intermediate layer in the present invention may preferably be formed from the organic acid and the organic aluminum compound in an acid/aluminum (=RCOOH/Al) mol ratio of 0.5 to 1.

The intermediate layer of the photosensitive member of the present invention may be formed by applying the aqueous dispersion sol thus obtained onto a support, and drying the thus-formed coating layer at a temperature of preferably 100 to 250° C., more preferably 120 to 160° C. If the drying temperature is below 100° C., the resultant intermediate layer is liable to show a weaker strength, and above 250° C., the resultant photosensitive member is liable to show a lower sensitivity.

The intermediate layer may preferably be formed in a thickness of 0.1 to 3 μm, more preferably 0.3 to 1 μm. If the thickness is below 0.1 μm, the effect of the present invention is liable to be scarce, and above 3 μm, the light-part potential or the residual potential is liable to be increased.

In the present invention, it is not preferred to add binder resin component for the purpose of, e.g., providing an intermediate layer having a better film property, since this is liable to result in a lowering in barrier function in a high temperature/high humidity environment.

The photosensitive layer formed on the intermediate layer in the photosensitive member of the present invention may be roughly classified into a so-called single layer-type containing both a charge-generating material and a charge-transporting material in a single layer, and a so-called lamination type including a charge generation layer containing a charge-generating material and a charge transport layer containing a charge-transporting material. The lamination type is further classified into a type including the support, the charge generation layer and the charge transport layer disposed in this order, and a type including the support, the charge transport layer and the charge generation layer disposed in this order. The photosensitive layer used in the present invention may preferably be the lamination type, particularly the type including the charge transport layer disposed on the charge generation layer.

The charge generation layer may be formed by applying and drying a coating liquid formed by dispersing a charge-generating material together with a binder resin in an appropriately selected solvent. Examples of the charge-generating material may include: azo pigments, inclusive of monoazo, bisazo and trisazo pigments; phthalocyanines and non-metallic phthalocyanine; indigo pigments, such as indigo and thioindigo; polycyclic quinone pigments, such as anthanthrone and pyrenequinone; perylene pigments, such perylenic acid anhydride and perylenic acid imide; equalylium dyes; pyrylium and thiopyrylium salts; and triphenylmethane dyes. Examples of the binder resin may include: polyvinyl acetal, polystyrene, polyester, polyvinyl acetate, methacrylic resin, acrylic resin, polyvinylpyrrolidone and cellulosic resin. The charge generation layer may preferably have a thickness of at most 5 μm, more preferably 0.05–2 μm.

The charge transport layer may be formed by applying and drying a coating liquid formed by dissolving a charge-transporting material in a solution of a film-forming resin. The charge-transporting material may be roughly classified into an electron-transporting material and a hole-transporting material. Examples of the electron-transporting material may include: electron-accepting materials, such as 2,4,7-trinitrofluorenone, 2,4,5,7-tetrachlorofluorenone and chroranil, and polymerized derivatives of such electron-accepting materials. Examples of the hole-transporting-material may include: polycyclic aromatic compounds, such as pyrene and anthracene; heterocyclic compounds, such as carbazole, indole, imidazole, oxazole, thiazole, oxadiazole, pyrazole, pyrazoline, thiadiazole, and triazole; hydrazone compounds, such as p-diethyaminobenzaldehyde-N,N-diphenylhydrazone and N,N-diphenylhydrazino-3-methylidene-9-ethylcarbazole styryl compounds, such as α-phenyl-4'-N,N-diamino-stilbene and 5-[4-(di-p-tolylamino)benzylidene]-5H-dibenzo [a,d]dicycloheptene; benzidine compounds; triarylamine compounds; triphenylamine; and polymers including these compounds in their main chain or side chain, such as poly-N-vinylcarbazole and polyvinylanthracene. Examples of the film-forming resin may include: polyesters, polycarbonates, polymethacrylate esters and polystyrene. The charge transport layer may preferably have a thickness of 5 to 40 μm, more preferably 10 to 30 min. Particularly, the present invention exhibits a remarkable effect at a small thickness of 15 μm or smaller which is advantageous for providing high-resolution images but is liable to result in fog.

The single layer-type photosensitive layer may be formed by applying and drying a coating liquid formed by dispersing or dissolving the charge-generating material and the charge-transporting material together with a binder resin in a solvent. The photosensitive layer may preferably have a thickness of 5 to 40 μm, more preferably 10–30 μm. For a similar reason as the charge transport layer, the present invention is particularly effective at a photosensitive layer thickness of 15 μm or smaller.

In the present invention, it is also possible to use a photosensitive layer comprising a layer of organic photoconductive polymer, such as polyvinylcarbazole or polyvinylanthracene; a vapor-deposition layer of the above-mentioned charge-generating substance, selenium, selenium-tellurium or amorphous silicon.

The electroconductive support may for example comprise: aluminum, aluminum alloy, copper, zinc, stainless steel, titanium, nickel, indium, gold, or platinum. It is also possible to form an electroconductive support by vapor-deposition of such a metal or alloy onto a support of a plastic material, such as polyethylene, polypropylene, polyvinyl chloride, polyethylene terephthalate, or acrylic resin; coating such a support of plastic, metal or alloy with a layer of electroconductive particles together with an appropriate binder resin; or impregnating a support of plastic or paper with electroconductive fine particles. Particularly, it is possible to easily form an electroconductive layer having a uniform surface by forming a layer of electroconductive fine particles dispersed in a polymer binder. The electroconductive fine particles may have a primary particle size of at most 100 nm, preferably 50 nm or smaller. The electroconductive fine particles may for example comprise: conductive zinc oxide, conductive titanium oxide, Al, Au, Cu, Ag, Co, Ni, Fe, carbon black, ITO, tin oxide, indium oxide or indium, or insulating fine particles coated with such an electroconductive material. The electro-conductive fine particles may be used in a proportion sufficient to provide a layer having a sufficiently low volume resistivity of preferably at most $1\times10^{10}$ ohm.cm, more preferably $1\times10^{8}$ ohm.cm or below. The support may have a shape of e.g., a drum, a sheet or a belt, selected to most suit the photosensitive member to be produced.

In the case of using coherent light such as laser light as exposure light, the electroconductive support may be provided with surface unevennesses so as to prevent image deterioration due to interference, e.g., by forming unevennesses on the order of a half (½) of wavelength of the used light by dispersing e.g., silica beads or silicone-resin particles of several μm or smaller in diameter at a pitch of 10 μm or shorter. It is also possible to provide such surface unevennesses by surface roughening as by etching, blasting or cutting.

In the photosensitive member according to the present invention, the photosensitive layer can be further coated with a protective layer comprising a layer of resin alone or together with electro-conductive fine particles dispersed therein.

The above-mentioned resinous layers including the photosensitive layer may be formed by various coating methods, inclusive of dipping, spray coating, beam coating, spinner coating, roller coating, wire bar coating and blade coating.

Next, some description will be made on the process cartridge and the electrophotographic apparatus according to the present invention.

FIG. 1 shows a schematic structural view of an electrophotographic apparatus including a process cartridge using an electrophotographic photosensitive member of the invention. Referring to FIG. 1, a photosensitive member 1 in the form of a drum is rotated about an axis 2 at a prescribed peripheral speed in the direction of the arrow shown inside of the photosensitive member 1. The peripheral surface of the photosensitive member 1 is uniformly charged by means of a primary charger 3 to have a prescribed positive or negative potential. At an exposure part, the photosensitive member 1 is imagewise exposed to light 4 (as by slit exposure or laser beam-scanning exposure) by using an image exposure means (not shown), whereby an electrostatic latent image is successively formed on the surface of the photosensitive member 1. The thus formed electrostatic latent image is developed by using a developing means 5 to form a toner image. The toner image is successively transferred to a transfer (-receiving) material 7 which is supplied from a supply part (not shown) to a position between the photosensitive member 1 and a transfer charger 6 in synchronism with the rotation speed of the photosensitive member 1, by means of the transfer charger 6. The transfer material 7 carrying the toner image thereon is separated from the photosensitive member 1 to be conveyed to a fixing device 8, followed by image fixing to print out the transfer material 7 as a copy outside the electrophotographic apparatus. Residual toner particles remaining on the surface of the photosensitive member 1 after the transfer operation are removed by a cleaning means 9 to provide a cleaned surface, and residual charge on the surface of the photosensitive member 1 is erased by a pre-exposure means issuing pre-exposure light 10 to prepare for the next cycle. The pre-exposure means can be omitted, as the case may be.

According to the present invention, in the electrophotographic apparatus, it is possible to integrally assemble a plurality of elements or components thereof, such as the above-mentioned photosensitive member 1, the primary charger (charging means) 3, the developing means and the cleaning means 9, into a process cartridge 11 detachably mountable to the apparatus main body, such as a copying machine or a laser beam printer. The process cartridge may, for example, be composed of the photosensitive member 1 and at least one of the primary charging means 3, the developing means 5 and cleaning means 9, which are integrally assembled into a single unit capable of being attached to or detached from the apparatus body by the medium of a guiding means such as a rail 12 of the apparatus body.

In the case where the electrophotographic apparatus is used as a copying machine or a printer, for example, the imagewise exposure light 14 may be provided as reflected light or transmitted light from an original, or signal light obtained by reading an original by a sensor, converting the read data into signals, and scanning a laser beam or driving a light-emitting device, such as an LED array or a liquid crystal shutter array, based on the signals.

The electrophotographic photosensitive member according to the present invention may be used not only in an electrophotographic copying machine and a laser beam printer, but also in other electrophotography-applied apparatus, such as a CRT printer, an LED printer, a facsimile apparatus, a liquid crystal printer and a laser plate making.

Hereinbelow, the present invention will be described more specifically with reference to Examples and Comparative Examples wherein "parts" and "%" used for describing a relative amount of a component or a material are by weight unless specifically noted otherwise.

EXAMPLE 1

Into a flask, 20 parts of aluminum tri-sec-butoxide was placed, and under stirring by a glass rod, 90 parts of hot water and 60 parts of 1N-acetic acid were added thereto. Vigorous stirring was continued for 10 min. after the addition to obtain a white aqueous dispersion sol. The sol was stirred for 4 days by a stirrer on an oil bath to obtain a colorless transparent viscous sol, which was then diluted with 150 parts of deionized water to form a coating liquid for an intermediate layer.

Separately, an aluminum cylinder (30 mm in outer diameter (OD)×254 mm in length (L), Rz (ten-point average roughness according to JIS-B0601)=0.03 μm) formed by drawing, as a support, was coated by dipping with a coating liquid formed by dissolving 167 parts of phenolic resin ("PLI-O-PHEN", made by Dai Nippon Ink Kagaku Kogyo K.K.) in 100 parts of methyl cellosolve and dispersing 200 parts of electro-conductive ultra-fine particles (primary particle size (Dp)=50 nm) and 3 parts of silicone resin particles (average particle size=2 μm), followed by drying, to form a 15 μm-thick electroconductive layer.

Then, the electroconductive layer was coated by dipping with the above-prepared coating liquid for an intermediate layer, followed by drying at 120° C. for 20 min. to form a 0.7 μm-thick intermediate layer.

Separately, a mixture of 4 parts of oxytitanium phthalocyanine pigment showing strong peaks at Bragg angles (2 θ±0.2 deg.) of 9.0 deg., 14.2 deg., 23.9 deg. and 27.1 deg. on a CuKα-characteristic X-ray diffraction pattern), 2 parts of polyvinyl butyral ("BX-1", made by Sekisui Kagaku Kogyo K.K.) and 34 parts of cyclohexanone was subjected to dispersion for 10 hours in a sand mill, and then diluted with 60 parts of tetrahydrofuran to form a coating liquid for a charge generation layer. The coating liquid was applied by dipping onto the above-prepared intermediate layer an dried at 83° C. for 10 min. to form a 0.2 μm-thick charge generation layer.

Then, 50 parts of a triarylamine compound represented by a structural formula below:

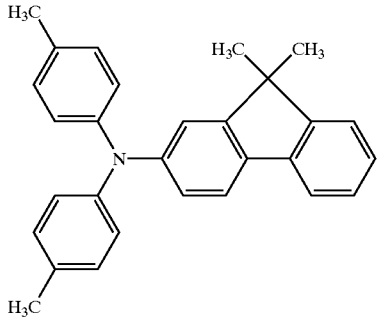

and 50 parts of a polycarbonate resin ("IUPILON Z-200", made by Mitsubishi Gas Kagaku K.K.) were dissolved in 400 parts of chlorobenzene to form a solution, which was then applied by dipping onto the above-formed charge generation layer and dried by heating at 117° C. for 1 hour to form a 15 μm-thick charge transport layer, thereby preparing an electrophotographic photosensitive member.

The above-prepared photosensitive member was set in a printer according to reversal development-type electrophotography ("Laser Writer 16/600 PS", made by Apple Computer, Inc.) and subjected to measurement of dark-part potential (Vd) and light-part potential (Vl) and evaluation with eyes of formed images in respective environments of normal temperature/normal humidity (25° C./50%RH), low temperature/low humidity (15° C./15%RH) and high temperature/high humidity (30° C./80%RH). The results are shown in Tables 1 and 2 appearing hereinafter together with those of Examples and Comparative Examples described hereinbelow.

As a result, as shown in Table 1, the photosensitive member provided a sufficiently large contrasts between the dark-part potential (Vd) and the light-part potential (Vl) even in the low temperature/low humidity and high temperature/high humidity environments. Further, as shown in Table 2, there were formed high-quality images which were almost free from unnecessary black spots or fog and free from toner scattering.

Figure 2:
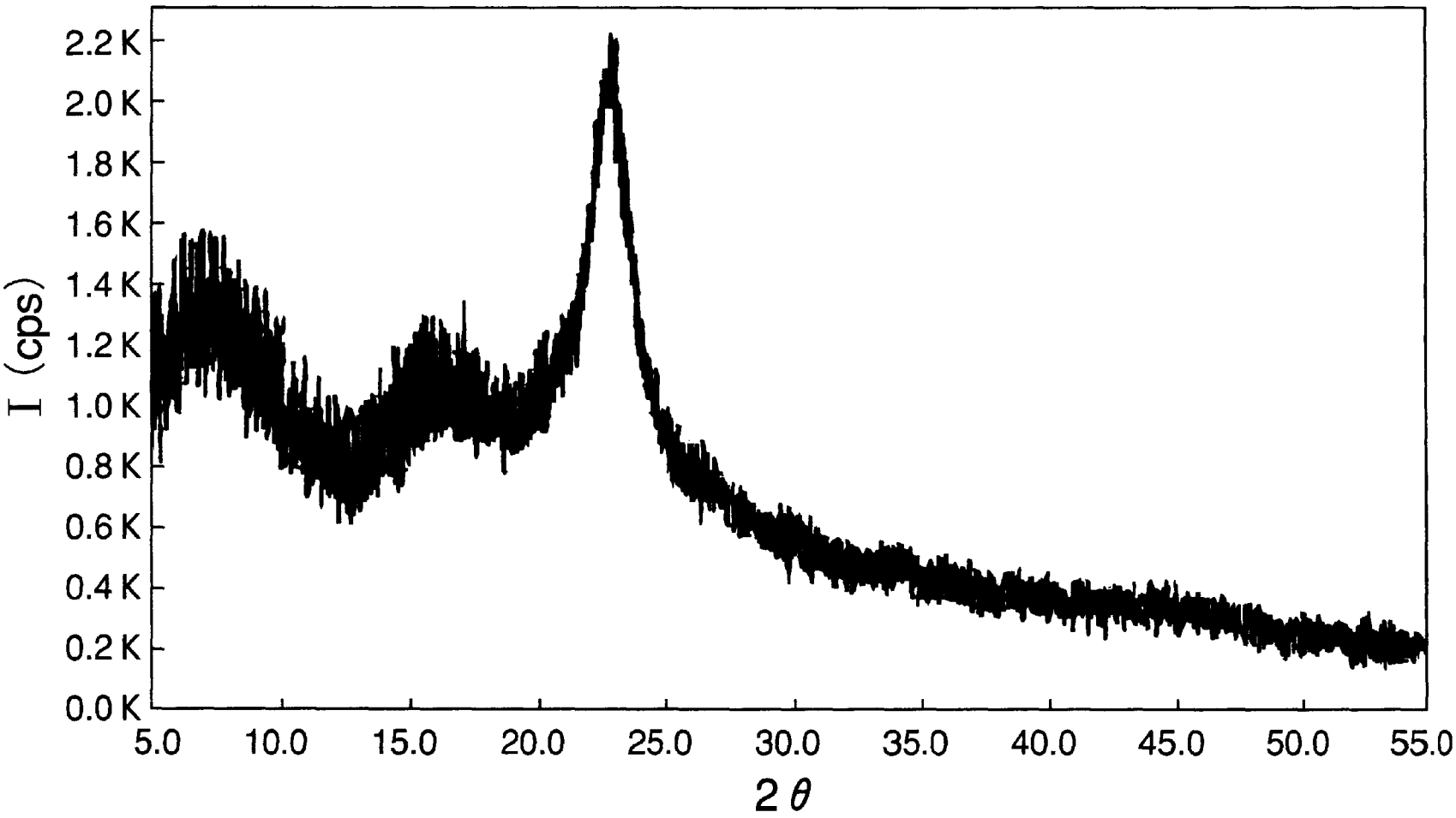
FIG. 2 reproduces an X-ray diffraction chart of an intermediate layer produced in Example 1.

Separately, the above-prepared coating liquid for an intermediate layer was applied by dipping on a glass sheet and dried at 120° C. for 20 min. to form a layer similarly as the above-formed intermediate layer in the photosensitive member. As a result of X-ray diffraction analysis, the layer provided a diffraction pattern as shown in FIG. 2 which did not exhibit diffraction peaks showing indices of plane corresponding to boehmite crystal phase.

EXAMPLE 2

An aluminum cylinder (OD=30 mm×L=254 mm) having a roughened surface (Rz (ten-point-average roughness according to JIS-B0601)=0.5 μm) was used as a support and coated with an intermediate layer similarly as in Example 1.

Thereafter, a charge generation layer and a charge transport layer were formed in the same manner as in Example 1 to form a photosensitive member, which was then evaluated in the same manner as in Example 1. As a result, the photosensitive member exhibited sufficiently large contrasts between the dark-part potential (Vd) and light-part potential (Vl) even in the low temperature/low humidity and high temperature/high humidity environments as shown in Table 1, and high-quality images were formed, which were free from unnecessary black spots or fog and free from toner scattering, as shown in Table 2.

EXAMPLE 3

A photosensitive member was prepared and evaluated in the same manner as in Example 2 except for forming an intermediate layer through drying at 160° C. for 2 hours (instead of 120° C. for 20 min). As a result, the photosensitive member exhibited sufficiently large contrasts between the dark-part potential (Vd) and light-part potential (Vl) even in the low temperature/low humidity and high temperature/high humidity environments as shown in Table 1, and high-quality images were formed, which were free from unnecessary black spots or fog and free from toner scattering, as shown in Table 2.

EXAMPLE 4

Into a flask, 17 parts of aluminum tri-iso-propoxide was placed, and under stirring by a glass rod, 105 parts of hot water and 45 parts of 1N-formic acid were added thereto. Vigorous stirring was continued for 10 min. after the addition to obtain a white aqueous dispersion sol. The sol was stirred for 4 days by a stirrer on an oil bath to obtain a colorless transparent viscous sol, which was then diluted with 150 parts of deionized water to form a coating liquid for an intermediate layer.

A photosensitive member was prepared and evaluated in the same manner as in Example 2 except for forming an intermediate layer by using the above-prepared coating liquid for an intermediate layer. As a result, the photosensitive member exhibited sufficiently large contrasts between the dark-part potential (Vd) and light-part potential (Vl) even in the low temperature/low humidity and high temperature/high humidity environments as shown in Table 1, and high-quality images were formed, which were free from unnecessary black spots or fog and free from toner scattering, as shown in Table 2.

Comparative Example 1

A coating liquid for an intermediate layer was prepared by dissolving 10 parts of alcohol-soluble copolyamide resin ("AMILAN CM-8000", made by Toray K.K.) in a mixture solvent of methanol 60 parts and n-butanol 40 parts.

A photosensitive member was prepared and evaluated in the same manner as in Example 1 except for forming a 1 μm-thick intermediate layer by using the above-prepared coating liquid for an intermediate layer and drying the applied coating liquid at 90° C. for 10 min.

As a result, the photosensitive member exhibited fairly large contrasts between Vd and Vl in all environments as shown in Table 1, but the resultant images in the high temperature/high humidity environment were accompanied with fog over the whole area presumably due to charge injection from the support as shown in Table 2.

Comparative Example 2

A photosensitive member was prepared and evaluated in the same manner as in Example 2 except for forming a 1 μm-thick intermediate layer by using the coating liquid for an intermediate layer prepared in Comparative Example 1 in the same manner as in Comparative Example 1.

As a result, the photosensitive member exhibited fairly large contrasts between Vd and Vl in all environments as shown in Table 1, but the resultant images in the high temperature/high humidity environment were accompanied with fog over the whole area presumably due to charge injection from the support, similarly as in Comparative Example 1.

Comparative Example 3

Into a flask, 20 parts of aluminum tri-sec-butoxide was placed, and under stirring by a glass rod, 14 parts of hot water and 4 parts of 1N-nitric acid were added thereto. Vigorous stirring was continued for 10 min. after the addition to obtain a white aqueous dispersion sol. The sol was stirred for 4 days by a stirrer on an oil bath to obtain a colorless transparent viscous sol, which was then diluted with 150 parts of deionized water to form a coating liquid for an intermediate layer.

A photosensitive member was prepared and evaluated in the same manner as in Example 2 except for forming an intermediate layer by using the above-prepared coating liquid for an intermediate layer.

As a result, the photosensitive member exhibited fairly large contrasts between Vd and Vl in all environments as shown in Table 1, but the resultant images formed in all the environments were accompanied with fog over the whole area presumably due to local charge injection from the support not reflected in the above-mentioned potential measurements.

Figure 3:
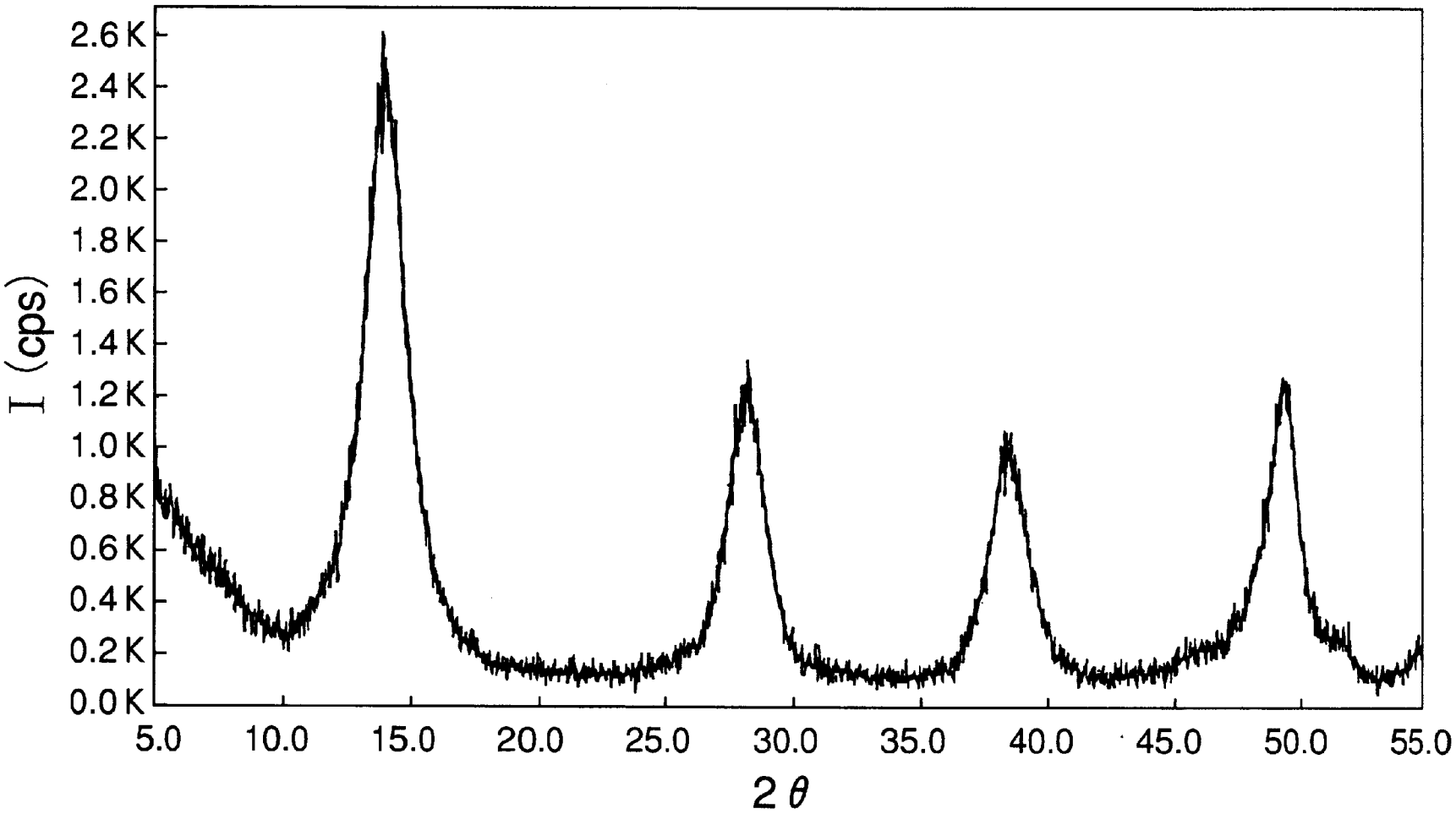
FIG. 3 reproduces an X-ray diffraction chart of an intermediate layer produced in Comparative Example 3.

Separately, the above-prepared coating liquid for an intermediate layer was applied by dipping on a glass sheet and dried at 120° C. for 20 min. to form a layer similarly as the above-formed intermediate layer in the photosensitive member. As a result of X-ray diffraction analysis, the layer provided a diffraction pattern as shown in FIG. 3 which exhibited diffraction peaks showing indices of plane corresponding to boehmite crystal phase.

The results of evaluation in the above Examples and Comparative Examples are summarized in Tables 1 and 2 below.

TABLE 1

Dark-part and Light-part potentials

| | 25° C./50% | | 15° C./15% | | 30° C./80% | |
|---|---|---|---|---|---|---|
| Example | Vd(V) | Vl(V) | Vd(V) | Vl(V) | Vd(V) | Vl(V) |
| 1 | −660 | −145 | −660 | −165 | −640 | −130 |
| 2 | −660 | −130 | −665 | −180 | −645 | −135 |
| 3 | −665 | −140 | −670 | −180 | −650 | −140 |
| 4 | −655 | −140 | −665 | −170 | −645 | −135 |
| Comp.1 | −655 | −130 | −675 | −200 | −640 | −140 |
| Comp.2 | −660 | −170 | −670 | −180 | −620 | −130 |
| Comp.3 | −665 | −160 | −635 | −195 | −625 | −130 |

TABLE 2

Image quality evaluation

| Example | 25° C./50% RH | 15° C./15% | 30° C./80% |
|---|---|---|---|
| 1 | good | good | slight fog |
| 2 | good | good | good |
| 3 | good | good | good |
| 4 | good | good | good |
| Comp.1 | good | good | wholly fogged |
| Comp.2 | good | good | wholly fogged |
| Comp.3 | wholly fogged | wholly fogged | wholly fogged |

What is claimed is:

1. An electrophotographic photosensitive member, comprising: a support, an intermediate layer and a photosensitive layer disposed in lamination in this order, wherein the intermediate layer comprises an organic acid aluminum salt compound and is free from an organic binder resin component.

2. A photosensitive member according to claim 1, wherein the organic acid aluminum salt compound has been formed by heating an aqueous dispersion sol formed by reaction of an organic aluminum compound or a hydrolyzate thereof with an organic acid in an aqueous medium.

3. A photosensitive member according to claim 2, wherein the aqueous dispersion sol is heated at 100–280° C.

4. A photosensitive member according to claim 2, wherein the organic acid is acetic acid or formic acid.

5. A photosensitive member according to claim 2, wherein the organic acid is used in an amount providing an organic acid/aluminum mol ratio of 0.5 to 1.

6. A photosensitive member according to claim 1 or 2, wherein the organic acid aluminum salt compound does not show an X-ray diffraction pattern corresponding to that of boehmite.

7. A process cartridge, comprising:

an electrophotographic photosensitive member; and at least one means selected from the group consisting of charging means, developing means and cleaning means, said electrophotographic photosensitive member and said at least one means being integrally supported and detachably mountable to a main assembly of an electrophotographic apparatus, wherein said electrophotographic photosensitive member comprises a support, an intermediate layer and a photosensitive layer in this order, and said intermediate layer comprises an organic acid aluminum salt compound and is free from an organic binder resin component.

8. An electrophotographic apparatus, comprising:

an electrophotographic photosensitive member; and charging means, developing means and transfer means respectively disposed opposite to the electrophotographic photosensitive member, wherein said electrophotographic photo-sensitive member comprises a support, an intermediate layer and a photosensitive layer and a protective layer in this order, and said intermediate layer comprises an organic acid aluminum salt compound and is free from an organic binder resin component.

* * * * *